United States Patent [19]

Strydom

[11] Patent Number: 4,903,712

[45] Date of Patent: Feb. 27, 1990

[54] CIGARETTES AND METHODS OF MAKING THEM

[75] Inventor: Mauritz L. Strydom, Stellenbosch, South Africa

[73] Assignee: Tobacco Research and Development Institute Limited, Switzerland

[21] Appl. No.: 366,296

[22] Filed: Jun. 13, 1989

Related U.S. Application Data

[63] Continuation of Ser. No. 60,975, Jun. 17, 1987, abandoned, which is a continuation of Ser. No. 809,734, Dec. 17, 1985, abandoned.

[30] Foreign Application Priority Data

Dec. 19, 1984 [ZA] South Africa ..... 84/9891
Nov. 14, 1985 [ZA] South Africa ..... 85/8737

[51] Int. Cl.[4] ..... A24C 5/14; A24C 5/18

[52] U.S. Cl. ..... 131/84.1; 131/94; 131/364

[58] Field of Search ..... 131/361, 364, 365, 358, 131/280, 94.1, 94

[56] References Cited

U.S. PATENT DOCUMENTS 872,987 12/1907 Capehart ..... 131/358
2,893,400 7/1959 Petert et al. ..... 131/358
3,219,040 11/1965 Kim ..... 131/360
3,356,094 12/1967 Ellis et al. ..... 131/360
3,614,956 10/1971 Thornton ..... 131/364
3,637,447 1/1972 Berger et al. .
4,142,534 3/1979 Brantl ..... 131/360
4,391,285 7/1983 Burnett et al. ..... 131/364

FOREIGN PATENT DOCUMENTS 822963 11/1951 Fed. Rep. of Germany ..... 131/364
2723177 11/1978 Fed. Rep. of Germany .

*Primary Examiner*—V. Millin
*Attorney, Agent, or Firm*—Ladas & Parry

[57] ABSTRACT

A method of making cigarettes in which a continuous strip of air-impervious material is formed into a tube which is then nipped at spaced intervals to form a string of chubs. This string of chubs is then introduced into the chimney of a conventional high speed cigarette making machine wherein a continuous cigarette rod of tobacco will be formed about the hollow chubs. The continuous rod is then severed at the nips between adjoining chubs. Thereafter as desired the sections are joined to filters with the filter tip sections being cut into individual cigarettes having the closed end of a chub adjacent each filter.

3 Claims, 3 Drawing Sheets

Fig. 1
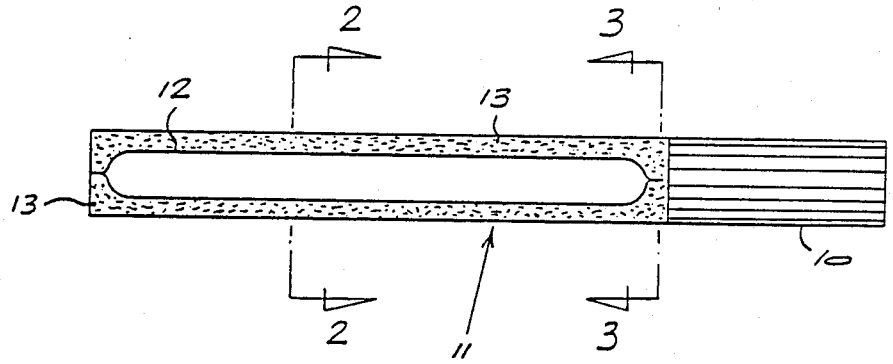
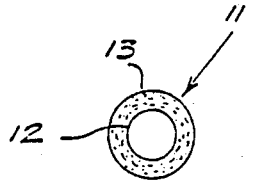
Fig. 2
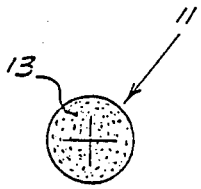
Fig. 3
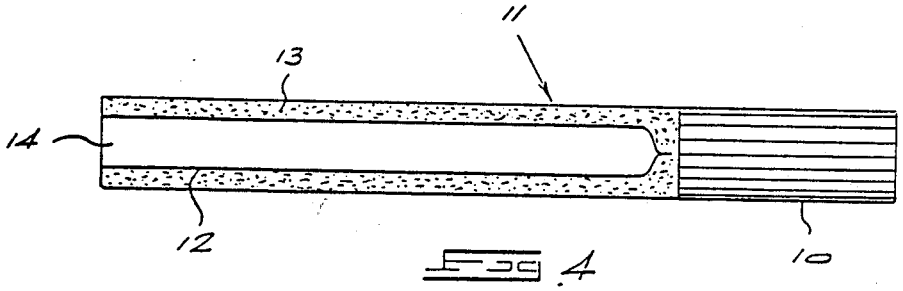
Fig. 4

FIG. 7
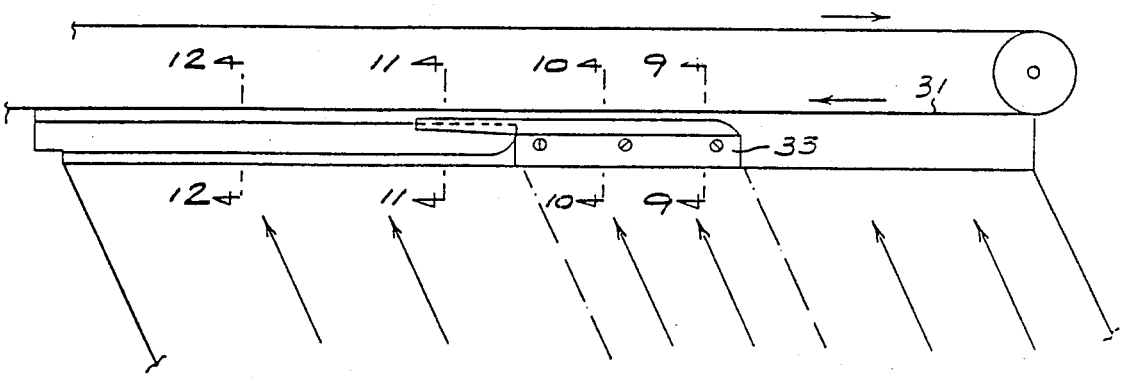
FIG. 8
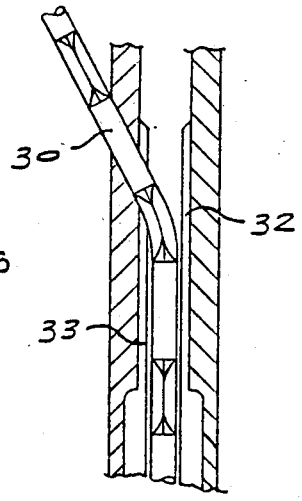
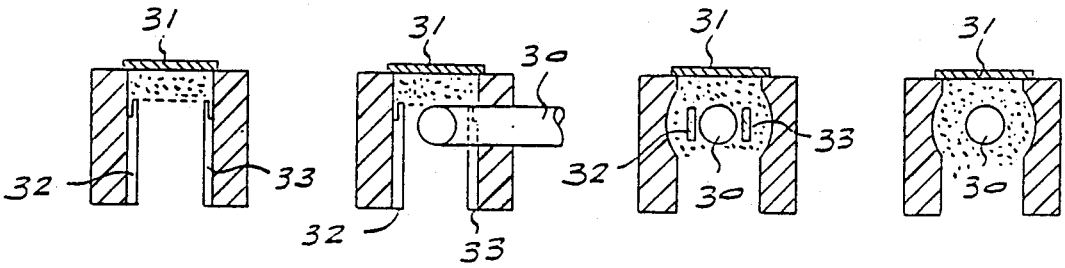
FIG. 9 FIG. 10 FIG. 11 FIG. 12

CIGARETTES AND METHODS OF MAKING THEM

This application is a continuation of application Ser. No. 07/060,975, filed June 17, 1987 now abandoned, which is a continuation of application Ser. No. 809,734, filed Dec. 17, 1985 now abandoned.

BACKGROUND OF THE INVENTION

This invention relates to cigarettes and methods of making them.

When a smoker puffs on a cigarette the burning of the ember of the cigarette takes place predominantly around the outer edges of the ember because of the resistance of the central part of the ember to air flow resulting from the puff.

It has already been proposed to make use of this effect, e.g. by putting a better grade of tobacco on the outer periphery and a weaker grade at the centre.

It is an object of the invention to utilize this effect in still a better manner.

SUMMARY OF THE INVENTION

According to the invention a cigarette includes an empty elongated chub made of a combustible material which is substantially gas-impervious, the chub being completely surrounded by tobacco.

The material may be cigarette paper or homogenized tobacco leaf.

Also according to the invention in making cigarettes a continuous strip of the air-impervious material is formed into a tube, the tube is nipped at spaced intervals, the nips are made permanent and the string of chubs thus formed is fed into the chimney of a cigarette making machine for a continous cigarette rod to be formed around the string.

In the machine the rod is further processed in a conventional way to make cigarettes. The cigarette cutting points and the nipping step are sychronized so that cutting takes place at the nips between chubs.

The invention also provides apparatus for forming a string of chubs which comprises a tube forming device around a hollow mandrel shaped as a glue applicator, and a nipping aperture which varies in shape from a large area to a narrow area in which the material forming the tube is pinched around a strip of glue applied by the glue applicator.

The nipping aperture may be formed by profiled wheels defining the aperture where they contact. Thus there could be four wheels with hollow profiled grooves on their surfaces and running synchronously.

DESCRIPTION OF THE DRAWINGS

FIG. 1 is a longitudinal section through a cigarette,

FIG. 2 is a section on the line 2—2 in FIG. 1,

FIG. 3 is a section on the line 3—3 in FIG. 1,

FIG. 4 is a section through another cigarette,

FIG. 7 is a schematic view of a chimney of a cigarette making machine,

FIG. 8 is a fragmentary top view of part of the chimney, and

FIGS. 9 to 12 are sections on the lines 9—9, 10—10, 11—11, 12—12 respectively of FIG. 7.

DESCRIPTION OF EMBODIMENTS

Figure 5:
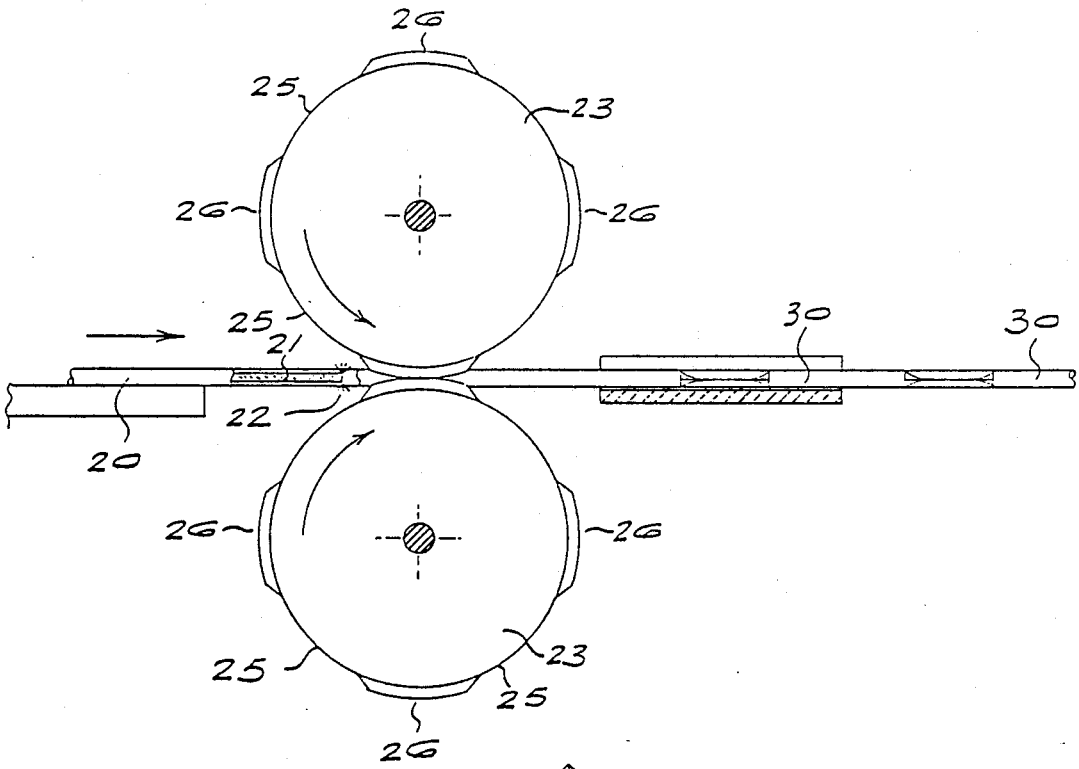
FIG. 5 is a schematic side view of a nipping device.

A cigarette according to the invention is shown in the drawings. That cigarette has a filter tip 10 and a body 11 composed of an empty chub 12 and shredded tobacco 13 around the chub 12 and at the ends of the chub 12.

The chub is formed by forming a paper tube and then pinching the tube at accurately spaced intervals as by twisting it. As a result a chain of chubs is formed.

On the cigarette making machine the chain of chubs is fed under the paper which already has a coating of tobacco and the tobacco is then applied to the underside of the chubs. The feeding of the chain of chubs is synchronyzed with the transverse cutting of the cigarette strand so that cuts are made in pinched portions of the chain.

The end result is a cigarette as shown in FIGS. 1 to 3. When smoked the cigarette gives an annular ember. There is no centre to the ember which is wasteful of valuable tobacco.

Figure 6:
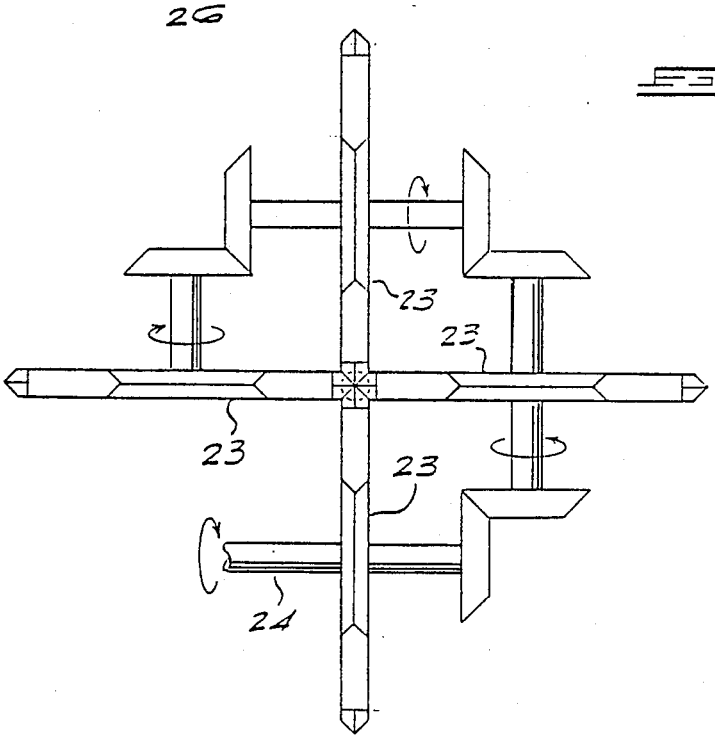
FIG. 6 is a view on the line 2—2 in FIG. 5.

In FIGS. 5 and 6 a chub making machine is illustrated. A narrow strip of cigarette paper is formed into a tube 20 around an inner pipe 21 which serves to dispense glue at its tip 22. The tube 20 with its inner strip of glue is passed through an aperture defined among four profiled wheels 23 driven by a shaft 24 in synchronism with the cigarette making machine before which the chub making machine is installed. When the zones 25 on the wheels 23 are in contact, the tube 20 passes through a large round aperture, but when the zones 26 are in contact the paper of the tube 20 is nipped and the nipped paper is glued together forming a string of chubs 30.

To ensure synchronism with the cigarette cutoff on the making machine a nucleonic sensor is used to determine the nip positions on the cigarettes passing through. If the nip position has to be changed two idler sprockets are moved left or right simultaneously to shift the relative position of the wheels 23 relatively to the drive shaft momentarily.

The string of chubs 30 is now passed to the chimney of a making machine as shown in FIGS. 7 to 12. In the chimney a layer of tobacco is formed on a suction belt 31 by means of suction on tobacco which is blown upwardly towards the belt. The conventional chimney is modified by the insertion of guide plates 32 and 33 for the string of chubs 30 which is fed in from the side as can be seen from FIG. 8.

FIGS. 8 to 11 illustrate clearly the events in the chimney and before the layer of tobacco reaches the paper wrapping stage. Hereafter the cigarette is formed in the conventional manner, but the result is unconventional in that each cigarette will be formed with a chub inside it.

Note that for cigarettes of FIG. 1 of cigarettes are cut from the continuous rod at the nips between chubs. For those of FIG. 4 the chubs have to be longer so that chubs can be cut in half while cuts also take place at the nips.

I claim:

1. A method of making cigarettes each of which incorporates a hollow tobaccoless region surrounded by air-impervious material characterized in that a continuous strip of an air-impervious combustible material is formed into a tube, the tube is nipped at equally spaced intervals to form a string of chubs closed at each end, the string thus formed is fed into the chimney of a cigarette making machine for a continuous cigarette rod to be formed around the string, the rod is cut into sections at alternate nip positions, a filter is joined to each section and the filter tipped sections are cut into individual cigarettes with an end of a chub adjacent a filter, so that each section contains a pair of chubs and each cigarette has a chub in it.

2. The method of claim 1 in which the air-impervious material is cigarette paper or homogenized tobacco leaf.

3. The method of claim 1 or 2 in which the tube is formed around a mandrel, glue is applied from the mandrel on to the interior of the tube, and the tube is nipped at the positions where the glue has been applied to form the string.

* * * * *